United States Patent [19]

Elsenheimer et al.

[11] Patent Number: 4,838,934

[45] Date of Patent: Jun. 13, 1989

[54] PROCESS FOR A DIRECT REDUCTION OF IRON OXIDE CONTAINING MATERIALS IN A ROTARY KILN

[75] Inventors: Gerd Elsenheimer, Frankfurt am Main; Wolfram Schnabel, Willich, both of Fed. Rep. of Germany

[73] Assignee: Metallgesellschaft Aktiengesellschaft, Frankfurt am Main, Fed. Rep. of Germany

[21] Appl. No.: 62,731

[22] Filed: Jun. 16, 1987

[30] Foreign Application Priority Data

Jun. 21, 1986 [DE] Fed. Rep. of Germany ..... 3620842

[51] Int. Cl.[4] ..... C21B 11/06

[52] U.S. Cl. ..... 75/36; 266/173

[58] Field of Search ..... 75/33, 36; 266/173

[56] References Cited

U.S. PATENT DOCUMENTS

| | | | |
|---|---|---|---|
| 3,890,138 | 6/1975 | Hockin | 75/36 |
| 4,375,883 | 3/1983 | Keran et al. | 266/173 |
| 4,581,061 | 4/1986 | Ulrich et al. | 75/36 |

*Primary Examiner*—Melvyn J. Andrews

*Attorney, Agent, or Firm*—Sprung Horn Kramer & Woods

[57] ABSTRACT

The charge is moved through a rotary kiln countercurrently to the gas atmosphere. Solid carbonaceous reducing agent having a high content of volatile constituents is charged into the rotary kiln at its charging end. Solid carbonaceous reducing agent having a high content of volatile constituents is blown into the rotary kiln at its discharge end and is distributed over the charge in part of the length of the kiln. Oxygen-containing gases are supplied to the rotary kiln through its shell at a plurality of locations. In order to provide optimum operating conditions in the final zone of the kiln, solid carbonaceous material having a high content of volatile constituents is separated into a coarser fraction and a finer fraction, a part of the coarser fraction and a part of the finer fraction are mixed. The resulting mixture is blown by a blowing device into the rotary kiln at its discharge end, said mixture consists of an amount of 10 to 40% of the finer fraction and of an amount of 90 to 60% of the coarser fraction and is blown at a rate of up to 50% of the total feed rate of solid carbonaceous material. The blown mixture is distributed over up to 50% of the length of the kiln, and the remaining solid carbonaceous material is charged into the rotary kiln at its charging end.

7 Claims, 1 Drawing Sheet

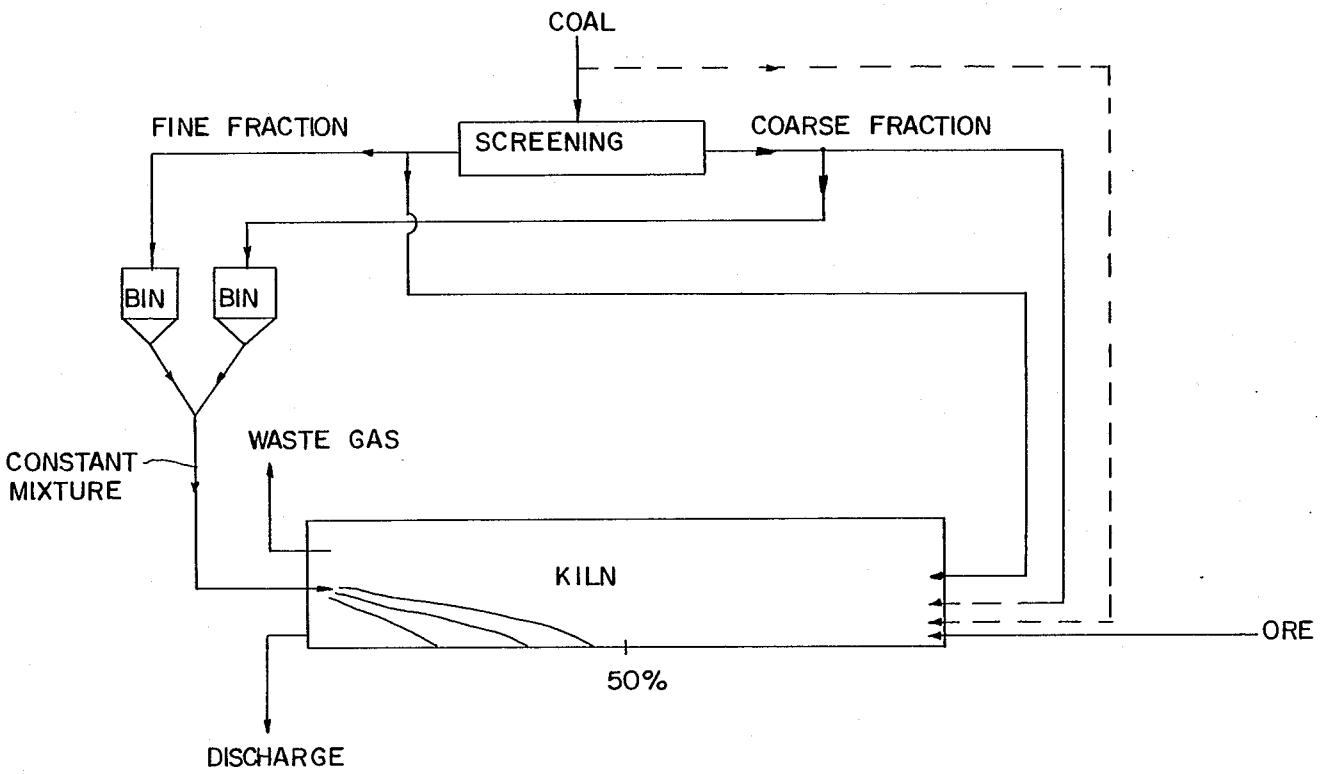
COAL
SCREENING
COARSE FRACTION
FINE FRACTION
BIN
BIN
CONSTANT MIXTURE
WASTE GAS
KILN
50%
ORE
DISCHARGE

PROCESS FOR A DIRECT REDUCTION OF IRON OXIDE CONTAINING MATERIALS IN A ROTARY KILN

BACKGROUND OF THE INVENTION

This invention relates to a process for a direct reduction of iron oxide containing materials to form sponge iron in a rotary kiln, wherein the charge is moved through the rotary kiln countercurrently to a gas atmosphere, solid carbonaceous reducing agent having a high content of volatile constituents is charged into the rotary kiln at its charging end, solid carbonaceous reducing agent having a high content of volatile constituents is blown into the rotary kiln at its discharge end and is distributed over the charge in part of the length of the kiln, and oxygen-containing gases are introduced into the rotary kiln through its shell at a plurality of locations.

That zone of the rotary kiln which directly precedes its discharge end is particularly susceptible to temperature fluctuations and to a depletion of carbon in the charge bed. This may result in fluctuations of the degree of metallization, in a formation of deposits in the kiln and in a higher heat consumption.

Various proposals have been disclosed as to how part of the solid carbonaceous reducing agent can be pneumatically blown into the rotary kiln at its discharge end and can be distributed over the charge in part of the length of the kiln.

From U.S. Pat. No. 981,280 it is known to blow pulverulent bituminous coal by means of air through a first blowing device, which acts like a burner for pulverized coal. A second blowing device is used to blow lump coal having a particle size of 10 to 20 mm through a second blowing device.

U.S. Pat. No. 4,378,244 teaches blowing 10 to 35% of the entire coal as a fraction having a particle size from 0 to 12.5 mm into the kiln at its discharge end by two blowing devices and distributing said coal over at least 50% of the length of the kiln. The remaining coal having a particle size up to about 50 mm is charged into the kiln at its charging end.

Canadian Patent No. 872,728 teaches blowing coal having a particle size up to 6 mm into the kiln at its discharge end by means of a blowing device and charging the remaining coal into the kiln at its charging end, with the exception of coal which has a particle size below 1 mm and which is also blown into the kiln at its discharge end.

Indian Patent Specification No. 142,368 teaches separating the entire coal at a sieve cut of 6 mm, charging the coarse fraction into the kiln at its charging end and blowing the fine fraction into the kiln at its discharge end. The fine fraction is blown in by one or two blowing devices at a rate of 40 to 70% of the total rate.

Published German Application No. 33 32 556 teaches blowing 60 to 100% of the fresh feed coal into the kiln at its discharge end and states that the blown coal must not contain more than 20% of that fine fraction, which has a particle size below 4 mm and is contained in the entire amount of fresh feed coal. The coal is blown into the kiln by two blowing devices. One blowing device is used to blow part of the coal which has passed through the sieve and contains the permissible amount of the fraction having a particle size below 4 mm and to distribute said part of the coal over not more than 20% of the length of the kiln. A second blowing device is used to blown coal which has been retained on the sieve and has a particle size above 4 mm. That coal is distributed over the length portion of the kiln between points which are spaced 20 and 70% of the length of the kiln from the discharge end.

These above mentioned processes, however, cannot always maintain optimum operating conditions in the final zone of the rotary kiln.

SUMMARY OF THE INVENTION

It is an object of the invention to always maintain optimum operating conditions in the final zone of the rotary kiln.

This object is accomplished in accordance with the invention in that solid carbonaceous material having a high content of volatile constituents is separated into a coarser fraction and a finer fraction, a part of the coarser fraction and a part of the finer fraction are mixed, the resulting mixture is blown by a blowing device into the rotary kiln at its discharge end, said mixture consists of an amount of 10 to 40% of the finer fraction and of an amount of 90 to 60% of the coarser fraction and is blown at a rate of up to 50% of the total feed rate of solid carbonaceous material, the blown mixture is distributed over up to 50% of the length of the kiln, and the remaining solid carbonaceous material is charged into the rotary kiln at its charging end.

In the solid carbonaceous reducing agent the content of combustible volatile constituents is in excess of 20%. Part of the reducing agent having a lower content of volatile constituents may also be charged into the kiln at its charging end. The oxygen-containing gases generally consist of air and are blown into the kiln through shell pipes having outlet openings disposed on the longitudinal axis of the kiln and/or through nozzle blocks having outlet openings disposed approximately in the lining of the kiln. Air is suitably introduced into the kiln at its discharge end through the air tube of the central burner. The central burner is operated to heat up the kiln when the latter is started and during standstill periods and can be used for short periods of time for effecting a temperature rise. The coarser and finer fractions may be obtained by a separation of the entire solid reducing agent or of a particular stream thereof. The separation in suitably effected by vibratory sieving.

Those quantities of finer and coarser fractions which are not required to be blown into the kiln are charged into the kiln at its charging end. Any reducing agent which is not subjected to said separation is also charged into the kiln at its charging end. The length of the kiln over which the blown reducing agent is distributed is measured from the discharge end of the kiln. The proportion of the finer fraction in the blown mixture will be selected to lie in the upper range if the reducing agent has a relatively low content of volatile constituents because it will be necessary in that case to burn fine-grained reducing agent at a higher rate in order to supply the required heat.

That proportion will be selected to lie in the lower range if the content of volatile constituents is relatively high because more heat will be supplied in that case by the combustion of the volatile constituents which have been expelled. The sieve cut for the separation of the reducing agent is selected in dependence on the reactivity of the coal, on its content of volatile constituents and on the operating conditions required in the kiln. If the rotary kiln is operated at a low throughput rate, the percentage of blown carbonaceous material in the total feed rate will lie in the upper range.

In a preferred embodiment the separation of the solid carbonaceous material is effected at a sieve cut between 3 mm and 5 mm. The term "sieve cut" indicates that a sieve having certain size in that range is used. A sieve cut in that range will result in particularly good operating conditions in most cases.

In a preferred embodiment the blown mixture of carbonaceous material consists of an amount of 15 to 30% of the finer fraction and of an amount of 85 to 70% of the coarser fraction. That mixing ratio will result in particularly good operating conditions in most cases.

In a preferred embodiment, the mixture of solid carbonaceous material is blown at a rate of 15 t 30% of the total feed rate of carbonaceous material. This will result in particularly good operating conditions in most cases, particularly when the throughput rates are high.

A further feature resides in that the particle size of the injected coarser fraction is maintained below an upper limit and the coarses having a particle size above said limit are separated and charged into the rotary kiln at its charging end. The coarses may be removed before the separation into finer and coarser fractions or may be removed from the coarser fractions after said fractions have been separated. As a result, the blown coarser fraction will not contain oversize coal particles so that the discharge material will contain less surplus carbon and more uniform operating conditions can be established in the kiln. That removal of coarses will be effected particularly if the reducing agent has a substantial and changing content of coarses.

In a preferred embodiment, the particle size of the blown coarser fraction is maintained below an upper limit of 10 to 15 mm. That limitation will result in particularly good operating conditions in the rotary kiln.

In a preferred embodiment, the finer and coarser fractions which have been separated are supplied to respective containers, the finer and coarser fractions ar withdrawn from the containers at the required rates and are mixed, the resulting mixture is blown into the rotary kiln at its discharge end, and surplus quantities of the finer and coarser fractions are caused to overflow separately from the containers and ar charged into the rotary kiln at its charging end. The term "containers" covers chutes, bins and the like.

Discharge means are provided at the lower end of the containers and serve for a controlled discharge of the finer and coarser fractions from the respective containers at the desired rates. Surplus quantities of the finer and coarser fractions flow out of the upper portion of the containers and are charged into the kiln at its charging end. Before the material is blown into the kiln at its discharge end or is charged into the kiln at its charging end, the streams consisting of the fractions are supplied to bins and are withdrawn from the latter at controlled rates. In that case the desired mixture of coarser and finer fractions can be obtained with very low expenditure and regardless of fluctuations in the particle size distribution of the supplied coal.

The invention will be further described with reference to the accompanying drawing.

A BRIEF DESCRIPTION OF THE DRAWING

The drawing is a flow sheet of the novel process.

In the drawing, coal is subjected to screening to form a fine and a coarse fraction. A portion of the fine fraction and a portion of the coarse fraction are forwarded to bins and materials are withdrawn from the bins at a constant ratio, mixed and introduced at the discharge end of the kiln. The balance of the fines and of the coarse fraction not forwarded to the bins are directly introduced into the feed end of the kiln along with the ore and optionally some unscreened coal, shown in broken lines.

The invention will be further explained and distinguished in the following examples wherein Example 1 is a comparison and Example 2 is in accordance with the invention.

The rotary kiln was 4.8 meters in diameter and had a length of 80 meters. It was provided with eight shell pipes and with three systems of nozzle blocks. Air was injected into the free space in the kiln through the shell pipes and nozzle blocks and was also injected into the charge through the nozzle blocks. The kiln was provided at its discharge end with a blowing device for coal and with a central burner.

The following raw materials were used:

| | | |
|---|---|---|
| Ore: | Fe content | 66.5% |
| | Moisture content | 0.5% |
| | Particle size | 5 to 20 mm |
| | Feed rate | 32,000 kg/h |
| Dolomite: | Particle size | 1 to 3 mm |
| | Feed rate | 1,500 kg/h |
| Coal: | Fixed carbon | 55% |
| | Volatiles | 32% |
| | Ash | 13% |
| | Sulfur | 0.6% |
| | Moisture content | 6% |
| | Particle size | 0 to 15% |
| | Proportion of particles below 5 mm | 5 to 50%, fluctuating |

EXAMPLE 1

Coal was charged into the rotary kiln at its charging end at a rate of 12,500 kg/h. Additional coal was blown into the kiln at its discharge end at a rate of 5,000 kg/h and distributed over a length of up to 25 meters, measured from the discharge end.

Strong fluctuations of the proportion of particles below 5 mm in the injected coal resulted in great variations in the temperature conditions in the kiln near its discharge end. If the proportion of such small particles was high, the temperatures rose strongly owing to the rapid combustion in the free space of the kiln and the charge bed was depleted of carbon because coarse particles entered the bed at a lower rate. As a result, the metallization was low although a high temperature was obtained in that portion of the kiln. The high temperature resulted in hot spots and in an increased formation of oversize particles.

| Product: | |
|---|---|
| Sponge iron | 21,8000 kg/h |
| Particle size | 0 to 50 mm |
| 10 to 15% | above 20 mm |
| Metallization | 85 to 95% |
| Proportion of non-magnetic matter discharged | 2 to 15% |

EXAMPLE 2

The process was the same as in Example 1 but coal was separated at a sieve cut of 5 mm into a coarser fraction of 5 to 15 mm and a finer fraction of 0 to 5 mm. The two fractions were separated stored in two bins and were withdrawn from the bins at a constant ratio by means of belt-type weigh-feeders and were then mixed and blown into the kiln through the blowing device Of the coal blown into the kiln at its discharge end at a rate of 5,000 kg/h, coal at a rate of 1,200 kg/h consisted of particles of 0 to 5 mm and coal at a rate of 3,800 kg/h consisted of particles of of 5 to 15 mm.

In the final part of the rotary kiln, a constant temperature of about 1090° C. was maintained in the kiln atmosphere.

| Product: | |
|---|---|
| Sponge iron | 21,8000 kg/h |
| Particle size | 0 to 20 mm |
| up to 1-2% | above 20 mm |
| Metallization | 93 to 96% |
| Proportion of non-magnetic matter discharged | 8 to 11% |

The advantages afforded by the invention reside in that highly constant conditions can be maintained in the rotary kiln in its final zone immediately preceding the discharge end. Because the reducing agent is separated into a coarser fraction and a finer fraction and said fractions are mixed at constant rates, a constant ratio of said rates can exactly be maintained even though the contents of fine particles in the coal as supplied usually exhibit continual fluctuations. As a result, the temperature conditions in the kiln and the carbon content of the charge can be maintained substantially constant and can be changed quickly and in a controlled manner in case of need. That ratio can be adjusted and maintained constant so that in an operation using only a single blowing device, the rapid combustion of the fine-grained coal flying in the kiln will result in a constant temperature and in a consumption of the oxygen content of the entraining air at a rapid, constant rate so that coarser coal flying in the kiln atmosphere will be burnt only at low rate. As a result, blown-in carbon will be introduced into the charge bed at a constant rate.

It will be appreciated that the instant specification and claims are set forth by way of illustration and not limitation, and that various modifications and changes may be made without departing from the spirit and scope of the present invention.

What is claimed is:

1. In a process for a direct reduction of iron oxide-containing materials to form sponge iron in a rotary kiln, wherein a charge of such material is moved through the rotary kiln counter-currently to a gas atmosphere, solid carbonaceous reducing agent having a high content of volatile constituents is charged into the rotary kiln at its charging end, solid carbonaceous reducing agent having a high content of volatile constituents is blown into the rotary kiln at its discharge end and is distributed over the charge in part of the length of the kiln, and oxygen-containing gases are introduced into the rotary kiln through its shell at a plurality of locations, the improvement comprising separating a solid carbonaceous reducing agent having a high content of volatile constituents into a coarser fraction and a finer fraction, forming a mixture of a part of the coarser fraction and a part of the finer fraction, blowing the resulting mixture into the rotary kiln only at its discharge end, wherein said mixture consists of an amount of 10 to 40% of the finer fraction and of an amount of 90 to 60% of the coarser fraction and is blown at a rate of up to 50% of the total feed rate of solid carbonaceous reducing agent, distributing the blown mixture over up to 50% of the length of the kiln, and charging the remaining solid carbonaceous reducing agent into the rotary kiln at its charging end.

2. A process according to claim 1, wherein the solid carbonaceous reducing agent is separated at a sieve cut of 3 to 5 mm.

3. A process according to claim 1, wherein the blown mixture of carbonaceous reducing agents consists of an amount of 15 to 30% of the finer fraction and of an amount of 85 to 70% of the coarser fraction.

4. A process according to claim 1, wherein the mixture of solid carbonaceous reducing agents is blown at a rate of 15 to 30% of the total feed rate of carbonaceous material.

5. A process according to claim 1, wherein the finer and coarser fractions which have been separated are supplied to respective containers, the finer and coarser fractions are withdrawn from the containers at the required rates and are mixed, and the resulting mixture is blown into the rotary kiln at its discharge end.

6. A process according to claim 1, wherein from the coarser fraction to be blown in there is withdrawn material above a predetermined particle size, the withdrawn oversized material being charged into the rotary kiln at its charging end.

7. A process according to claim 6, wherein the particle size of the not-withdrawn blown coarser fraction is maintained below an upper limit between 10 and 15 mm.

* * * * *